US005678617A

United States Patent [19]

Kuykendal et al.

[11] Patent Number: 5,678,617

[45] Date of Patent: Oct. 21, 1997

[54] METHOD AND APPARATUS FOR MAKING A DRINK HOP ALONG A BAR OR COUNTER

[76] Inventors: Robert Kuykendal; Ronald Deichmann, both of 1136 Washington, St. Louis, Mo. 63101

[21] Appl. No.: 526,368

[22] Filed: Sep. 11, 1995

[51] Int. Cl.[6] ..... B67D 1/00

[52] U.S. Cl. ..... 141/392; 141/1; 141/98; 141/67; 222/129.1; 40/406; 40/439; 239/16; 239/18; 239/23

[58] Field of Search ..... 239/16–23; 141/1, 141/67, 98, 392; 222/129.1; 40/406, 407, 409, 439, 442

[56] References Cited

U.S. PATENT DOCUMENTS

| | | | |
|---|---|---|---|
| 1,536,188 | 5/1925 | Brown | 40/406 |
| 1,672,910 | 6/1928 | Saalburg | 40/406 |
| 2,888,205 | 5/1959 | Trucco | 239/20 |
| 3,775,883 | 12/1973 | Atkins | 40/409 |
| 3,782,729 | 1/1974 | Ernst | 40/409 X |
| 4,111,363 | 9/1978 | Kawamura et al. | 239/20 |
| 4,426,021 | 1/1984 | Rosenthal | 222/129.1 |
| 4,901,922 | 2/1990 | Kessener et al. | 239/18 X |
| 4,978,066 | 12/1990 | Fuller et al. | 239/23 X |
| 5,078,320 | 1/1992 | Fuller et al. | 239/20 |
| 5,124,088 | 6/1992 | Stumphauzer | 222/129.1 X |
| 5,165,580 | 11/1992 | Rosenthal | 40/439 X |
| 5,335,705 | 8/1994 | Morishita et al. | 141/67 X |

FOREIGN PATENT DOCUMENTS

| | | | |
|---|---|---|---|
| 487576 | 12/1953 | Italy | 40/406 |
| 404018591 | 1/1992 | Japan | 40/409 |
| 222091 | 2/1925 | United Kingdom | 40/406 |

*Primary Examiner*—J. Casimer Jacyna
*Attorney, Agent, or Firm*—Henry W. Cummings

[57] ABSTRACT

This invention involves a Jumping Drink Bar Device. This document discloses a novelty device for installation in a bar or counter whereby when a patron orders a specific drink the bartender or host places a drinking glass upon a designated location on top of the bar and, unknown to the patron, activates a hidden control. The drink then seems to hop from some remote spot on the bar and take one or more leaps, ultimately landing in the patron's glass.

56 Claims, 6 Drawing Sheets

METHOD AND APPARATUS FOR MAKING A DRINK HOP ALONG A BAR OR COUNTER

FIELD OF THE INVENTION

This invention relates to a method and apparatus for forming a novelty device for use in conjunction with a bar or counter whereby when a patron orders a drink the bartender or host places a drinking glass on a designated location on the top of the bar or counter and upon activation of a control, the drink takes one or more hops from a remote location and lands in the patron's glass or a designated area on the bar or counter.

BACKGROUND OF THE INVENTION

It is common place in bars, restaurants and lounges, and in some bars located in homes, to provide apparatus for mixing various drinks. This apparatus frequently includes a CO2 container for creating pressure and a variety of mixes including ginger ale, tonic, seven up, coke, etc. to be supplied upon pressing an appropriate control.

In addition in some installations alcoholic beverages can also be supplied including beer, gin, whiskey, scotch, or vodka, as examples.

In addition in bars both in restaurants and lounges, and at home frequently people who are seated at the bar are telling stories and occasionally tricks are played in a friendly manner by the host or bartender and/or one or more of the guests.

U.S. Pat. No. 5,160,086 discloses a method and apparatus for forming fluid streams with very laminar flow.

SUMMARY OF THE INVENTION

One object of the present invention is to provide a method for generating a drink which appears to hop from a remote spot on the bar or counter and take one or more leaps, before landing in a patron's glass, or on a designated area on the bar or counter.

Another object of the present invention is to provide an apparatus whereby a drink appears to hop from a remote spot on the bar or counter and take one or more leaps and ultimately land in a patrons glass, or on a designated area on the bar or counter.

This invention involves a Jumping Drink Bar Device. This document discloses a novelty device for installation in a bar whereby when a patron orders a specific drink the bartender or host places a drinking glass upon a designated location on top of the bar, and unknown to the patron, activates a hidden control. the drink then seems to hop from some remote spot on the bar and takes one or more leaps, ultimately landing in the patron's glass.

Other objects will be apparent from the following description and drawings.

THE DRAWINGS

DESCRIPTION OF PREFERRED EMBODIMENTS

Figure 1:
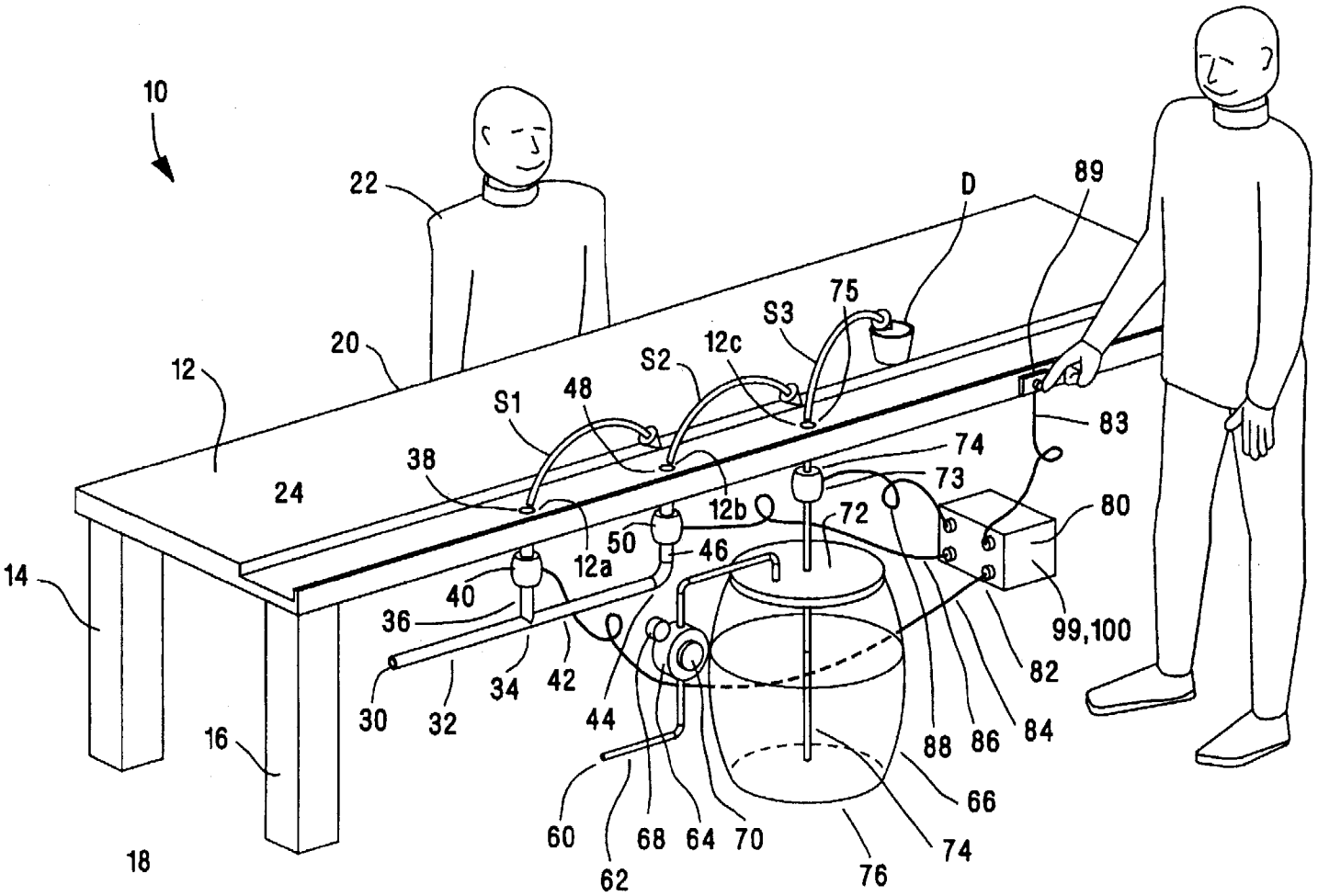
FIG. 1 is a schematic perspective view of a first embodiment of the bouncing drink assembly of the present invention.

The bouncing drink of apparatus of the present invention is indicated generally at (10) in FIG. 1. This apparatus includes a bar or counter (12) having laterally spaced supports (14) and (16) supporting the bar or counter on a floor (18). One or more seats (20) are provided for patron or guest (22) to be located adjacent to bar. The bar (12) includes a vertically upstanding flange (24).

Means for providing water for the bar is indicated generally at (30) and includes a conduit (32) extending to a water source (not shown). Conduit (32) extends to a T (34), where a first upwardly extending conduit (36) is located. Conduit (36) extends to a nozzle (38) controlled by a solenoid valve (40) of known construction which can be purchased on the open market, such as an ASCO valve, catalog #32, part 8210614. Nozzle assembly (38) may be constructed in a manner according to U.S. Pat. No. 5,160,086 hereby incorporated into this application by this reference to obtain laminar flow or according to other known constructions for forming a water jet, such as a common smooth-bore nozzle.

Conduit (32) extends beyond valve (34) as indicated at (42) and a right angle joint (44) is provided whereby a vertically extending conduit portion (46) is in fluid communication with another nozzle orifice (48) controlled by a solenoid valve (50) also of the above conventional construction. Nozzle (48) maybe constructed in the same manner as nozzle (38).

Means for supplying air pressure is indicated generally at (60) and includes a conduit (62) carrying pressurized air from a source (not shown) to a air regulator valve (64) and then into a container (66). Air regulator valve (64) includes a gauge (68) whereby the pressure going through the valve may be observed and a control (70) is provided to vary the air pressure going into the container (66). Such air regulator assemblies are well know in the art and are purchased as shelved items. An example of such a commercially available air regulator assembly is a Speedaire Regulator, stock #1Z885B available from Granger catalogue 382, 1992.

Container (66) includes a top (72) through which extends a tube (74) downwardly adjacent bottom (76) of the container (66). Tube (74) extends upwardly through top (72) into an opening (12*c*) in the bar (12).

Openings are aim provided in the bar at (12*a*) adjacent nozzle assemble (38) and opening (12*b*) is provided adjacent nozzle assemble (48).

The substance in container (66) may be water, a soft drink, beer, gin, vodka, whiskey, scotch or other beverages.

Tube (74) includes an upper portion (78) which is in fluid communication with a solenoid (73) valve of known construction and a nozzle assembly (75) which is communicating with the opening (12*c*) in the bar.

A control system (80) for operation of the assembly is included including an electrical circuit (82) having a pair of wires (84), which provides electrical connection to solenoid valve (40), electrical wire (86) which provides electrical connection to solenoid valve (50) and electrical wire (88) which provides electrical connection to solenoid valve 73. Electrical control wires (83) provide electrical connection to an electrical control button (89) which is located at a place hidden from view of the patron, but accessible to the bartender or attendant.

The control system (80) includes a controller (98). Such controllers (98) are commercially available and an example is a Klockner-Moeller model PS4-111-DR1. Alternatively controller (98) includes a computer (99) which is programmed with a suitable computer programs (100). Controller (98) activates solenoid valves (40), (50) and (73) in sequence. Thus when the bartender or attendant touches the control button (102) water is dispensed from nozzle assemble (38) through opening (12*a*) to cause water to flow to a flow in an arcuate manner S1, to area on the bar adjacent to opening (12*b*). Then the controller activates solenoid valve (50) causing nozzle assembly (48) to cause a second arcuate fluid stream (S2) to go through opening (12*b*) to a point in the area on the bar adjacent opening (12*c*). After this occurs the controller activates solenoid valve (73) causing nozzle assembly (75) to cause a third arcuate stream (S3) to go through opening (12*c*) to a designated spot on the bar or counter where the bartender or attendant has previously placed glass D. It is within the scope of the present invention that the complete method and apparatus may embody three hops as shown or may embody more or less than three.

Figure 2:
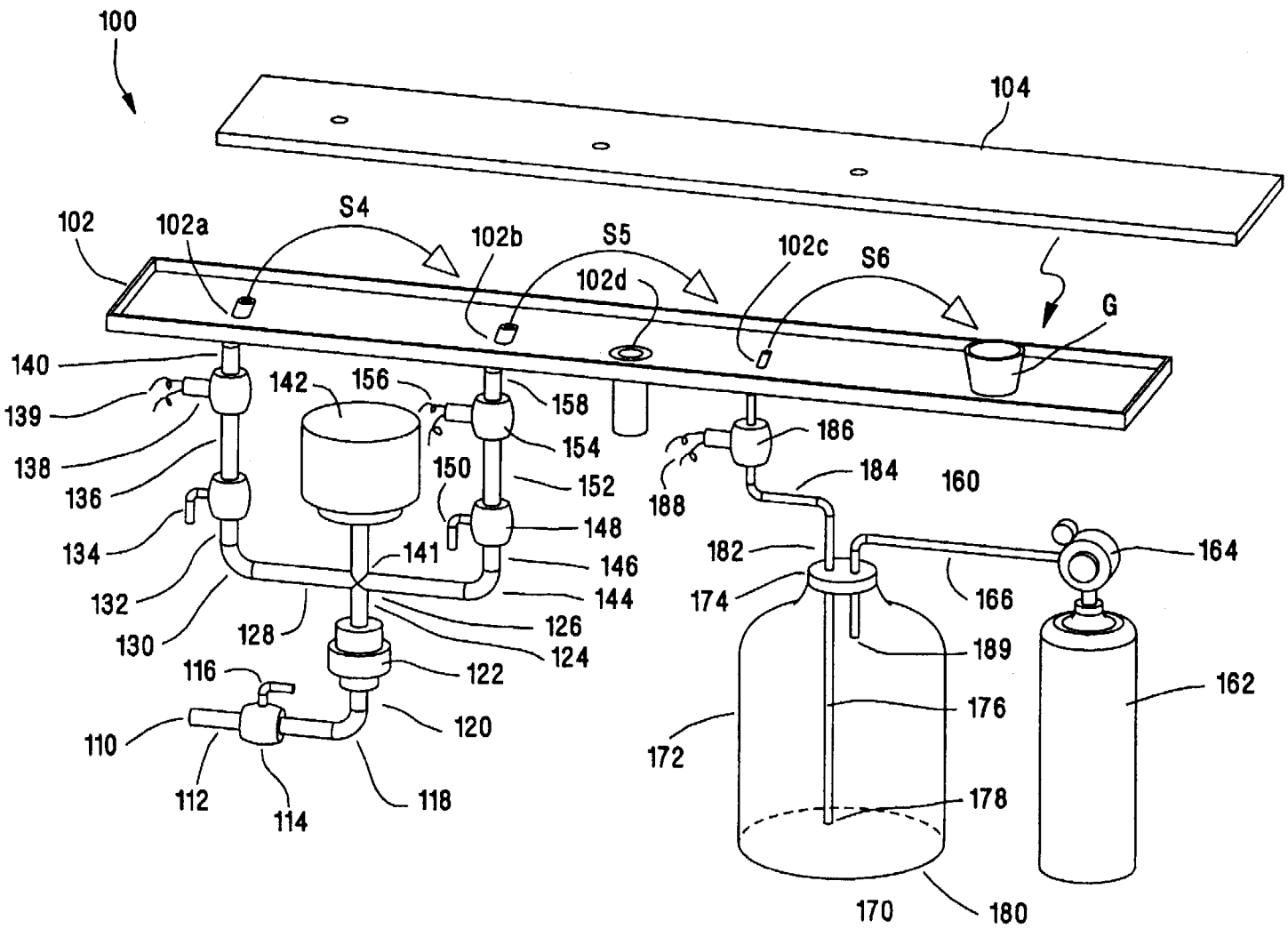
FIG. 2 is a schematic perspective view of another embodiment of the bouncing drink assembly of the present invention.

Another embodiment of the present invention is shown FIG. 2. In this embodiment indicated generally at (101) a tray (102) is provided conveniently made of metal or plastic and is adopted to receive a splash guard (104) which aim functions as part of the bar top or counter top.

This splash guard is formed of material which maybe of the type described in grater detail in U.S. Pat. No. 5,160,086 as diffuser material in columns 3 and 4 hereby incorporated into the present application by this reference.

A plurality of openings are provided in the tray indicated at (102*a*), (102*b*) and (102*c*). A larger opening is also provided in the tray as a drain indicated at (102*d*).

A source of municipal water is indicated at (110). This source of municipal water includes a conduit (112) having a main shut off valve (114) operative by means of a handle (116).

The conduit (112) includes a (118) right angle bend and a vertical conduit portion (120) containing a check valve (122). Check valve (122) is of conventional construction and an example is a ball check valve #2X611 available from Granger Catalogue #382, 1992. These are thus available on the open market.

A conduit portion (124) above the check valve (122) extends to a T (126). Fluid may flow through a first conduit (128) through right angle bend T (130) to a valve (132) having an operating handle (134) which is used to control the height that the water will flow above the splash guard.

Above valve (132) is another vertical conduit portion (136) which extends to a operating valve (138) which is preferably electrically operated through wires (139), but optionally maybe air operated. Suitable valves of the type indicated are commercially available and an example is given with reference to valve (38). If laminar flow is desired the nozzle means describe in U.S. Pat. No. 5,160,086 hereby incorporated into this application maybe utilized. In this regard splash absorbent material (104) may be made of material described in the U.S. Pat. No. 5,160,086.

In any event, above valve (138) is a conduit portion (140) which extends through opening (102*a*) in tray (102) and also extends through diffuser material (104). By proper adjustment of valve (130) an arcuate spray S4 will extend above diffuser material (104) and go to the point generally in the area of opening (102*b*).

Conduit (124) through conduit (141) also extends to an accumulator (142) to maintain sufficient water available for operation of the valve system.

Conduit (124) also is in communication through a conduit (144) and right angle bend T (146) with another valve (148) similar to valve (132) having a handle (150) to control the height of another arcuate stream (S5) to be described hereinafter. Valve (148) is commercially available. An example is given with reference to valve (38). Valves (148) and (132) thus may be similar.

Valve (148) is in fluid communication through a vertical conduit portion (152) with a valve (154) which is similar to valve (138).

Again this valve (138) is preferably electrically operated through a control system including wires (156). Alternatively it maybe air operated.

As discussed previously if laminar flow is desired the nozzle assembly disclosed in U.S. Pat. No. 5,160,086 is preferred. In this regard the splash absorbent material maybe similar to the diffuser material described in this patent in columns 3 and 4.

Valve (154) includes a conduit portion (158) which extends through opening (102*b*) and tray (102).

Upon proper adjustment of valve handle (150) and activation from the electrical system through wires (156) another arcuate jet or stream of water (85) will exit opening (102*b*) and go to the area indicated at (102*c*) and tray (102).

Means for supplying a drink is indicated at (160) and preferably includes a CO2 pressure container (162) having a pressure regulating valve (164) of known construction which is commercially available. An example of which is described in connection with valve (70). This CO2 container provides pressure through conduit (166) to a container indicated at (170) having a top portion (172) having an opening (174) which receives a tube (176) extending downwardly to a location (178) near the bottom (180) of the container (170). Tube (176) is in fluid communication with a coupling (182) through conduit (184), which extends to a valve (186) which is electrically operated by means of wires (188) or maybe air operated. Conduit (166) extends through the top of container (170) downwardly into the container (170) as indicated at (188).

Soft drinks or acholic beverages described above, or a mixture of the two may be provided in conduit (170). It is within the scope of the present invention to provide another conduit (171) similar to (170) which for example would contain an alcoholic beverage while conduit (170) would contain water or a mixer for the alcoholic beverage. Valve (186) also contains a handle (190) to control the height of a third stream (S6) which exits opening (102*c*) and goes to a drink glass (G) located upon the foam diffuser material (104).

The valve (186) may be a commercially available valve for example as described in connection with valves (38). If laminar flow is desired the valve assembly disclosed in U.S.

Pat. No. 5,160,086 maybe utilized. The splash absorbent material (104) maybe of the type described in columns 3 and 4 of this patent. The handle (190) may be utilized to control the extent of the arcuate movement (S6).

A control system (192) is provided. Preferably control system (192) is located in a area which is not visible by patrons on the opposite side (194) of the bar (104). This control system includes a system for providing three pulses in the embodiment illustrated in FIG. 2 in timed sequences to first activate valve (138) then valve (152) and then valve (186). This may be done with an IRC circuit or with a computer and appropriate programs, both techniques of which are presently known in the art and commercially utilized. Examples include a Klockner-Moeller Programmed Logic Controller model #PS4-111-DR1.

Is further within the scope of the present invention that the control system (192) be partly electrically and partly pneumatic, in which case operation of the valves (138), (154) and (186) are pneumatically operated. Timers are commercially available to activate such pneumatic operation from P. R. Mallory Co. & Inc for 0.10 to 10 sec., stock #7630K12 in McMaster-Carr catalogue #98, 1992.

In use, an operating button, (194) is pressed by the bartender or host which activates the control system (192), which activates the valve (138) to cause a first stream (S4) to arcuately flow above the foam material (104) to an area adjacent opening (102*b*) in the tray (102). When this occurrence is completed another fluid stream (S5) is activated by valve (154) to cause second fluid stream (S5) to flow to the area adjacent opening (102*c*). After this occurs a final fluid stream (S6) is activated from valve (186) to cause the final fluid stream (S6) to flow from the conduit (102*c*) into drinking glass (G) from the pressure from conduit (162) containing CO2 into one or more of the conduits (170) containing drink ingredients. Accumulator (142) insures that there will be plenty of water available for operation of the valves (138) and (154)

Modifications are within the scope of the present invention. Both the embodiment FIG. 1 and the embodiment in FIG. 2 may be modified to only include the final fluid streams (S3) or (S6) from the drink container to the drink, by simply not activating or leaving out the conduit and valve assembly necessary to produce the first fluid streams (S2) and (S4) and (S5) or by virtue of the control system only the last fluid stream (S3) or (S6) be utilized by appropriate adjustment of the control system.

Alternatively only one of the water streams (S2) or (S5) may be activated and the only the second stream (S3) or (S6) flow from the drink container (66) or (170).

While air pressure is utilized to activate the liquid drink substances in FIG. 1 and CO2 is utilized in the embodiment shown in FIG. 2, a wide variety of gaseous or non-gaseous means maybe provided to activate the fluid streams (S3), (S6) from the drink substance container (170) and/or (66). Also, streams (S3), (S6) may be supplied from a municipal water supply in the manner of streams (S1), (S2), (S4), (S5).

Figure 3:
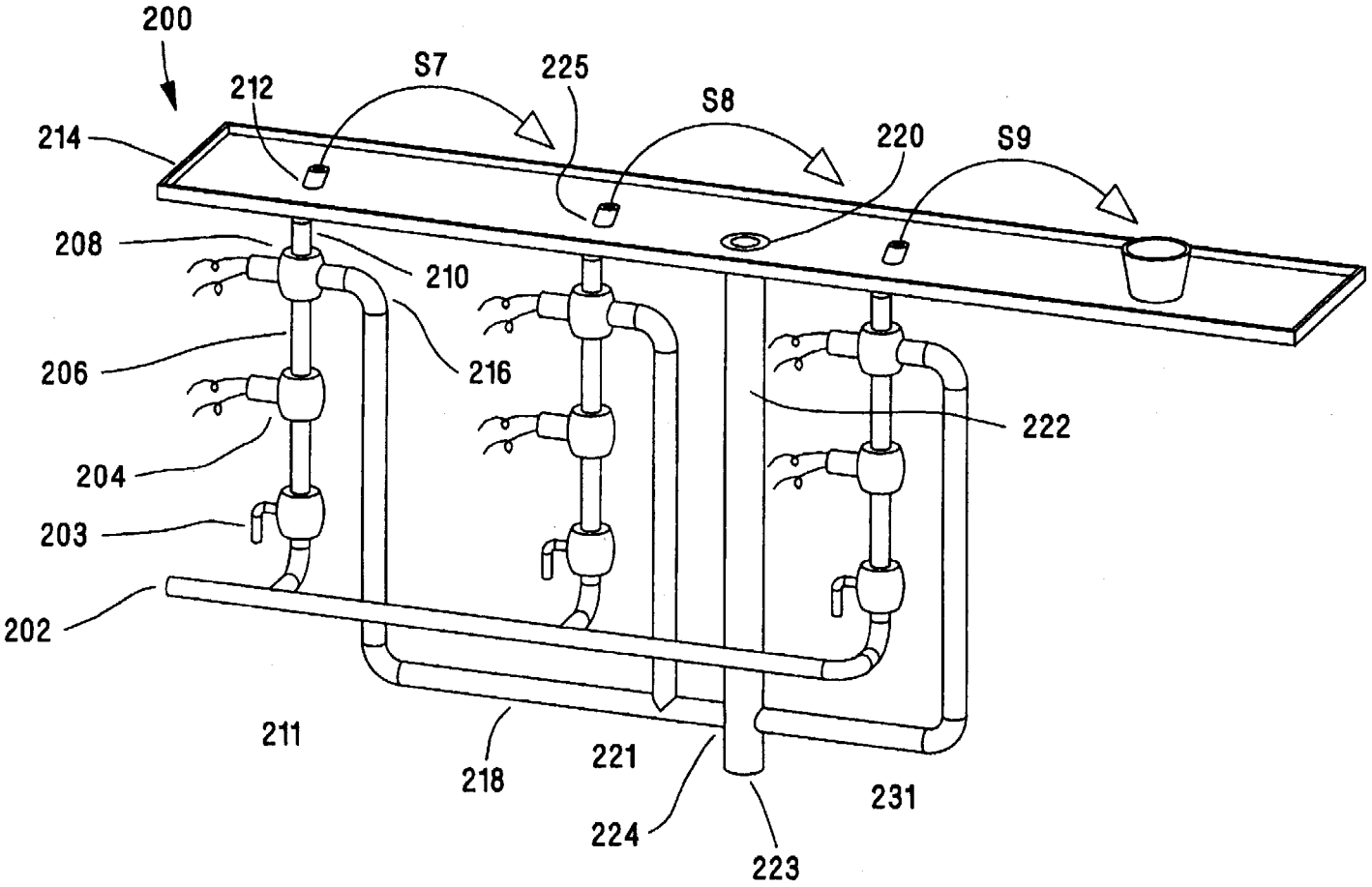
FIG. 3 is a schematic perspective view of another embodiment of the present invention.

Another embodiment of the present invention is indicated in FIG. 3 generally at (200). This embodiment contains the features described herein above with respect to FIG. 2. However, FIG. 2, the embodiment is modified to include a water supply for example from a municipality (202). This water supply, generally at (211), includes an off/on control valve (204) and a conduit (206) extends to a three way valve (208). Valve (208) is in fluid communication through conduit (210) with an opening (212) to direct fluid above the bar or counter (214).

In another position the valve (208) is in fluid communication with a conduit (216), which is in fluid communication with drain pipe (218) which is in fluid communication with drain conduit (222) at T connector (224) leading to the municipal drain at (223).

The three way valve (208) is designed to provide an initial short period of time 0.10–0.40 sec in a dump position in fluid communication with conduit (216), and then to cause a fluid pressure to go through conduit (210) and allow a stream (S7) to go through opening (212) and above the bar (214) to the area of the opening (225). An example of the dump valve (208) is an ASCO valve, catalog #32, part #8210614.

The dump valve allows the stream to build up speed before making the leap from the point (212) to the Point (225) and avoids dripping on the bar which some customers may find to be disadvantageous. A manual valve (203) in series with the two solenoid valves (206) and (208) provides an adjustment for the height of stream (S7). Another valve and conduit assembly at (221) is essentially the same as the assembly at (211) and provides for the second leap (S8). A third valve and conduit assembly at (231) is essentially the same as at (211) and (221) and provides for the third leap (S9).

Figure 4:
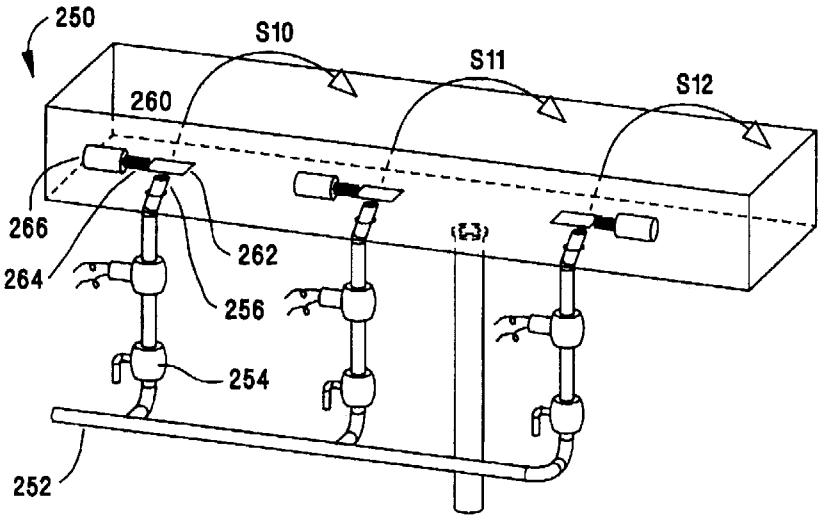
FIG. 4 is a schematic perspective view of another embodiment of the present invention.

Another embodiment is illustrated in FIG. 4 at (250). This embodiment includes a conduit (252) from a source of supply (not shown) containing a control valve (254). Valve (254) is in fluid communication with a conduit (256) through which fluid may exit and go above the bar in a stream (S10). An example of control valve (254) is to valve (38).

Figure 5:
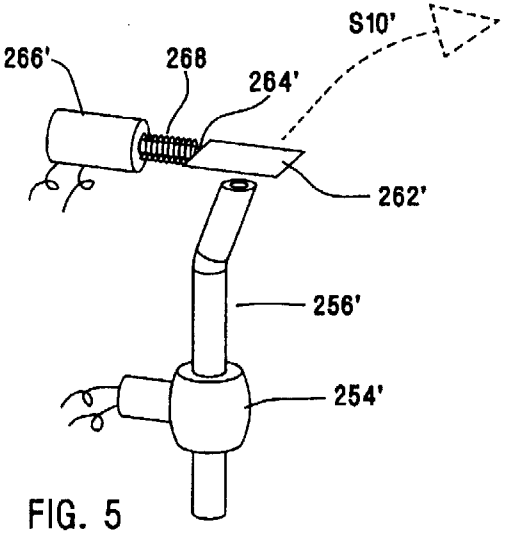
FIG. 5 is a schematic perspective view of the same embodiment of the present invention.
Figure 6:
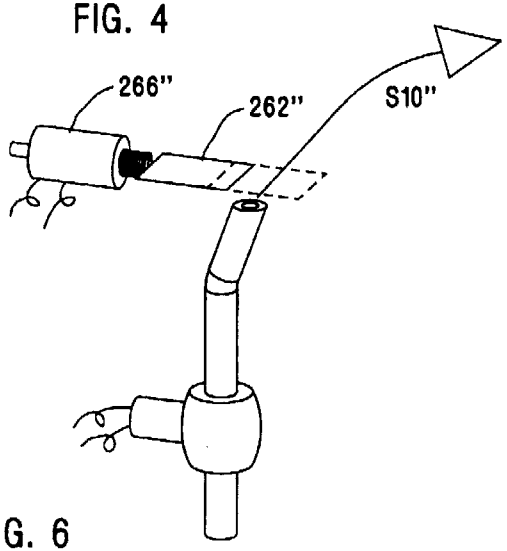
FIG. 6 is schematic perspective view of the same embodiment of the present invention.

A deflector assembly indicated generally at (260) includes a deflector body portion (262) and a control shaft (264). Body portion (262) blocks flow of fluid from conduit (256) from exiting the area. FIG. 5 shows a close-up view of the control valve (254), conduit (256), deflector body portion (262), control shaft (264), solenoid rod and coil assembly (266) and return spring (268), shown in the de-activated or blocking position. FIG. 6 shows the solenoid rod and coil assembly (266) in the activated position with the deflector body portion (262) shown in the blocking position, by the back and forth motion of the solenoid rod and coil assembly (266) and the return spring (268) in a known manner. A suitable rod and coil assembly (266) adopted to engage such a shaft (264) is number 70155K43 from the McMaster-Carr catalog #98, 1992.

In operation, the control valve (254) would first be activated to allow the water or beverage to attain full flow velocity exiting from the conduit (256) while still blocked from exiting the assembly as fluid stream (S10) by the deflector body portion (262). From 0.1 to 1.0 second later the solenoid rod and coil assembly (266) would be activated to retract and move the deflector body portion (262), (FIG. 6) to the unblocking position to allow fluid stream (S10) to exit the assembly. This embodiment allows the fluid stream to build up speed before making the leap as fluid stream (S10) and avoids dripping on the bar.

Alternatively the structure and method described in U.S. Pat. No. 5,161,740 may be used to generate discrete stream segments.

Figure 7:
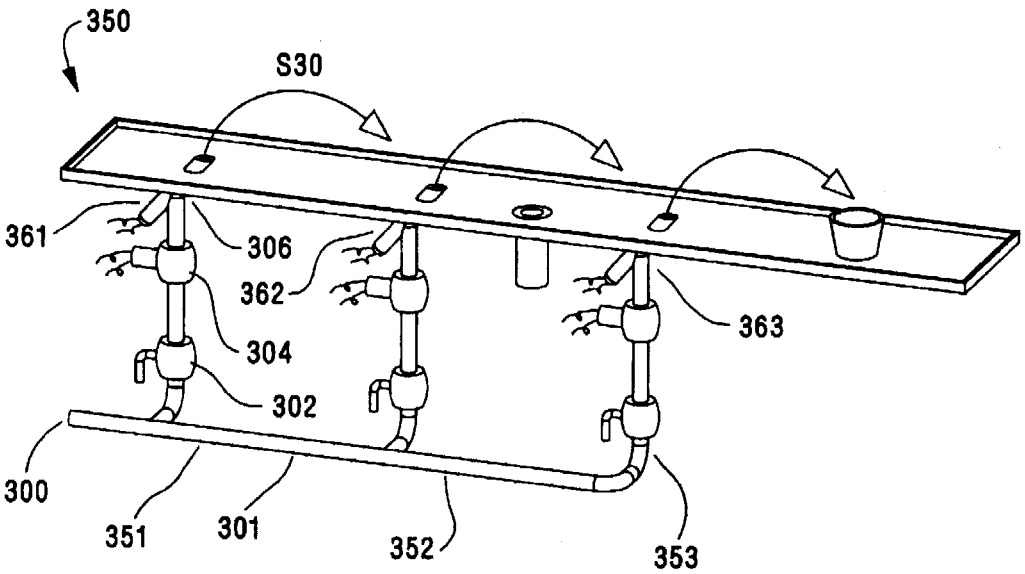
FIG. 7 is a schematic perspective view of another embodiment of the present invention.

Another embodiment of the present invention is indicated in FIG. 7, generally at (350). this embodiment contains the features described herein above with respect to FIG. 2. However, the FIG. 2, embodiment is modified to include a laser or other high intensity light source, shown as (361) on the first leap assembly shown generally at (351), as (362) on the second leap assembly at (352), and as (363) on the third leap assembly 358. Water or other beverage enters conduit (301) under pressure from some external source (not shown) at (300), whereupon it enters the first leap assembly through the manual height control valve (302), through the solenoid control valve (304) and enters the lighted nozzle assembly (306).

Figure 8:
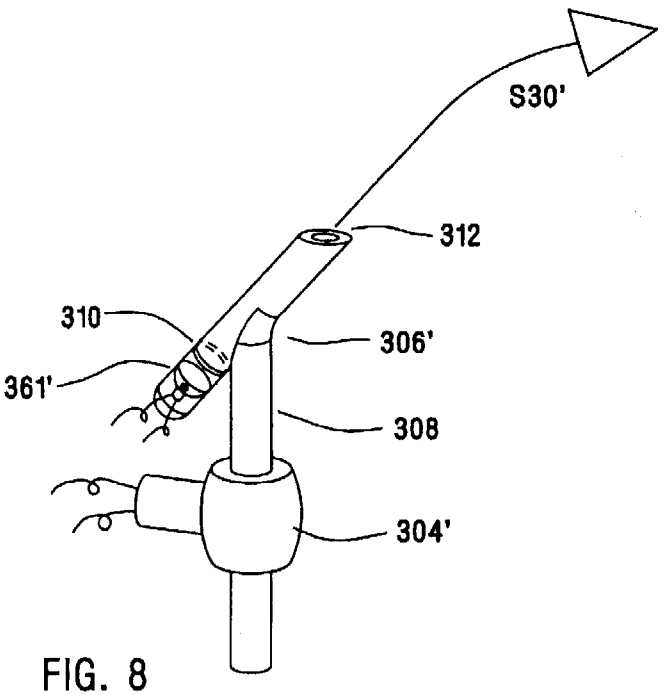
FIG. 8 is a schematic perspective view of the same embodiment of the present invention.

FIG. 8 shows a close-up view of the solenoid control valve (304'), lighted nozzle assembly (306') and light source (361'). The lighted nozzle assembly (306') is a generally cylindrical vessel in which liquid enters by an inlet port (308) and flows out through an outlet port (312) to form the fluid stream (530').

The rear portion of the lighted nozzle assembly is bounded by a fluid seal comprising of a transparent or color tinted window (310). A light source (361') is positioned just behind the window (310) in a manner to focus a beam of light through the window (310) and out of the nozzle through the orifice (312) so as to be embedded within the stream (530').

The effect of this embodiment will be to cause the leaping drink effect to be lighted and for the light to follow the leaping drink along the bar with the final leap to light up the patron's glass.

Figure 9:
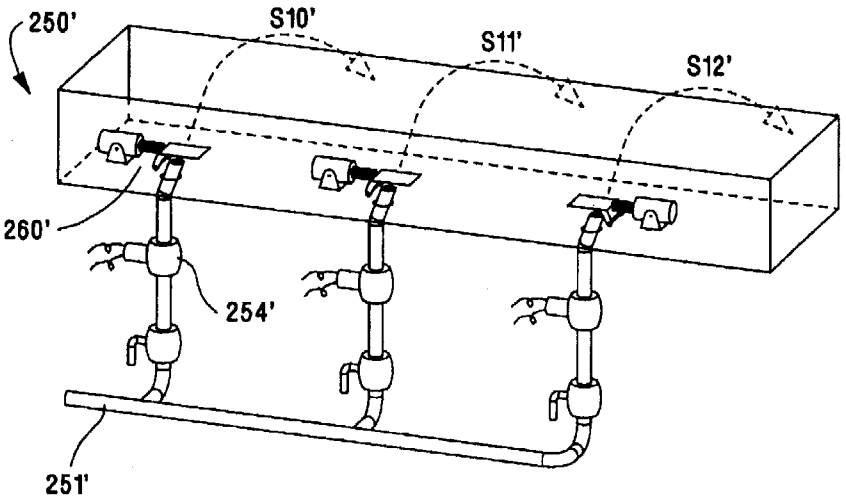
FIG. 9 is a schematic perspective view of another embodiment of the present invention.

In this embodiment, three leap stages are shown for convenience. It is within the scope of the present invention for the actual mechanism to be built for one leap or hop along a bar or counter, or for two, three or any number of hops. It is further within the scope of this invention for some hops to be lighted as in the fourth embodiment while others are not, for some hops to utilize a pressurized beverage container as in the first embodiment while others to utilize a municipal water supply or some other source. Likewise, it is within the scope of the present invention that some hops utilize the deflector plate of the third embodiment while others utilize the dump valve of the second embodiment or merely the solenoid control valve of the first and fourth embodiments Another embodiment is illustrated in FIG. 9 at (250)'. This embodiment includes a conduit (252)' from a source of supply (not shown) containing a control valve (254)'. Valve (254)' is in fluid communication with a conduit (256)' through which fluid may exit and go above the bar in a stream (S10). An example of control valve (254)' is to valve (38).

Figure 10:
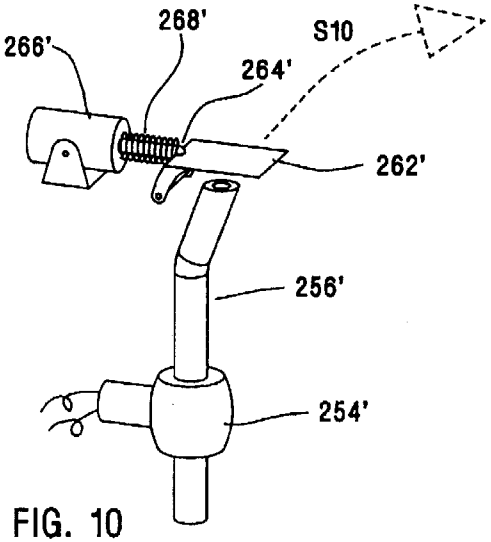
FIG. 10 is a schematic perspective view of the same embodiment of the present invention.
Figure 11:
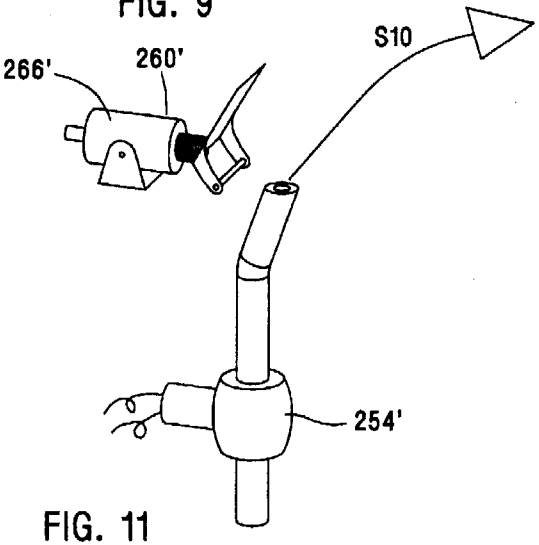
FIG. 11 is schematic perspective view of the same embodiment of the present invention.

A detector assembly indicated generally at (260)' includes a deflector body portion 262' pivotably mounted at 264'. Body portion (262) blocks flow of fluid from conduit (256)' from exiting the area. FIG. 10 shows a close-up view of the control valve (254'), conduit (256'), deflector body portion (262'), control shaft (264'), solenoid rod and coil assembly (266)' and return spring (268)', shown in the de-activated or blocking position. FIG. 10 shows the solenoid rod and coil assembly (266') in the activated position with the deflector body portion (262') shown in the blocking position, by the back and forth motion of the solenoid rod and coil assembly (266') and the return spring (268) in a known manner. A suitable rod and coil assembly (266') adopted to engage such a shaft (264)' pivots body portion 262' between the positions shown in FIGS. 10 and 11. A suitable rod and coil assembly (266') is part #70155K43 from the McMaster-Carr catalog #98, 1992.

In operation, the control valve (254)' would first be activated to allow the water or beverage to attain full flow velocity exiting from the conduit (256)' while still blocked from: exiting the assembly as fluid stream (S10') by the deflector body portion (262'). From 0.1 to 1.0 second later the solenoid rod and coil assembly (266)' would be activated to pivot and move the deflector body portion (262'), (FIG. 10) to the unblocking position to allow fluid stream (S10') to exit the assembly. This embodiment allows the fluid stream to build up speed before making the leap as fluid stream (S10') and avoids dripping on the bar.

In this embodiment, three leap stages are shown for convenience. It is within the scope of the present invention for the actual mechanism to be built for one leap or hop along a bar or counter, or for two, three or any number of hops. It is further within the scope of this invention for some hops to be lighted as in the fourth embodiment while others are not, for some hops to utilize a pressurized beverage container as in the first embodiment while others to utilize a municipal water supply or some other source. Likewise, it is within the scope of the present invention that some hops utilize the deflector plate of the third embodiment while others utilize the dump valve of the second embodiment or merely the solenoid control valve of the first and fourth embodiments.

Other modifications will be apparent within the scope of the following claims.

What is claimed is:

1. A system for conveying liquid in the interior of a building comprising a horizontal surface of a bar top, which horizontal surface is supported above ground level by at least one vertical leg and is adapted to be surrounded by seating and used as an eating and drinking surface to place food and drinks thereon; said surface having a receiving area;

a conduit containing a liquid to be transported to said area;

means for providing fluid pressure for moving the fluid in said conduit to a valving means;

said valving means effective to cause a fluid stream to flow from said conduit though an opening in said surface in an arcuate stream into said area; and means for controlling said valving means.

2. A system according to claim 1 including second valving means for supplying at least one second arcuate stream to flow to an area on the said bar or the counter adjacent the area where said first fluid stream emanates.

3. A system according to claim 2 including control means for controlling the sequence of said first fluid stream and said second fluid stream whereby said second fluid stream occurs prior to the activation of said first fluid stream.

4. A system according to claim 3 wherein means for supplying fluid to a third valving means is provided and wherein said third valving means activates a third fluid stream which follows an arcuate path to an area adjacent where said second fluid stream emanates.

5. A system according to claim 4 including control means for controlling the operation of said first, second and third fluid streams whereby said third fluid stream is activated first and upon completion of said third streams, said second fluid stream is activated and upon completion of said second fluid stream, said first fluid stream is activated.

6. A system according to claim 4 wherein said fluid is water provided to the facility and wherein a said source of water extends to said valve means which is controlled by a solenoid valve which is activated by said control means.

7. A system according to claim 6 wherein said second and third fluid streams are activated by solenoid valves which are in electrical communication with said control system.

8. A system according to claim 7 wherein said control means is partially electrical and partially pneumatically operated, and wherein said valving means is activated by air pressure.

9. A system according to claim 7 wherein accumulator means are provided in said water supply to insure that there is sufficient water available to provide said fluid streams.

10. A system according to claim 4 wherein height and reach valving means are provided to control the height and extent of reach of said first fluid stream.

11. A system according to claim 10 wherein height and reach valving means are provided to manually control the height and extent of reach of said second fluid stream.

12. A system according to claim 11 wherein height and reach valving means are provided to control the height and extent of flow of said third fluid stream.

13. A system according to claim 1 wherein said container is in fluid communication with a conduit which supplies fluid pressure to activate said first fluid stream.

14. A system according to claim 1 wherein said fluid pressure means comprises a gaseous medium.

15. A system according to claim 14 wherein said medium is selected from air and carbon dioxide.

16. A system according to claim 15 wherein said fluid pressure source is in fluid communication with a regulator valve.

17. A system according to claim 16 wherein regulator valve is manually operated to control the height of said first fluid stream.

18. A system according to claim 1 wherein said first fluid stream is a laminar flow fluid stream.

19. A system according to claim 1 wherein said valve means comprises a three-way dump valve said three-way dump valve being movable between a first position preventing communication between said bar opening and a second position allowing fluid communication with said bar opening; and control means for controlling the operation of said dump valve whereby said dump valve is moved between said first and second positions rapidly after sufficient fluid velocity has built up to prevent dripping of said fluid stream upon the bar.

20. A system according to claim 1 including means for deflecting located adjacent to said opening in said bar and means for moving said means for deflecting between a position blocking fluid flow and a second position allowing fluid flow from said opening and control means for controlling back and forth movement of said means for deflecting.

21. A system according to claim 20 wherein said means for deflecting includes an operating shaft and wherein said operating shaft is activated by a solenoid activator to move it between said first and second positions.

22. A system according to claim 21 wherein said means for deflecting is pivotally mounted and wherein means are provided to move said pivot operating shaft T and said means for deflecting between a position blocking flow from said opening in said bar and a position allowing flow from said bar opening.

23. A system according to claim 1 including means for providing a light source to light said fluid stream.

24. A system according to claim 23 wherein said light source is a high energy light source.

25. A system according to claim 24 wherein said high energy light source is a laser.

26. A system according to claim 23 including means for focusing said light source into said fluid stream.

27. A system according to claim 26 wherein said means for focusing comprises a window.

28. A system, according to claim 1 wherein said receiving area includes a drink glass.

29. A method of moving a liquid in the interior of a building on the horizontal surface of a bar top, which horizontal surface is supported above ground level by at least one vertical leg and is adapted to be surrounded by seating and used as an eating and drinking surface to place food and drinks thereon comprising:

providing a conduit containing the liquid to be transported to an opening on said surface;

providing a source of fluid pressure to said conduit;

providing a valving means in said conduit in communication with said opening;

applying said fluid pressure to said valving means whereby said liquid passes through said valving means and through said opening to cause a fluid stream of said liquid to flow from said opening in an arcuate fluid stream onto a selected area on said surface.

30. A method according to claim 29 wherein including forming a lamellar fluid stream with said valving means whereby said fluid stream flows arcuately into said area.

31. A method according to claim 29 including providing second valve means; supplying water to said second valving means, and activating said second valve means to cause water to flow from said second valving means in an arcuate fluid stream into a second area adjacent said opening in said bar or counter.

32. A method according to claim 31 including providing a third valving means; below said bar providing water to said third valving means; activating said first, second and third valving means sequentially, whereby a first fluid stream flows from said third valving means in an arcuate fluid stream to a third area adjacent said second valve means, and a second fluid stream flows from said second valving means to a second area adjacent said first opening and a third fluid stream of liquid from said container flows through said first opening and in an arcuate fluid stream into said first area.

33. A method according to claim 32 including providing control means for sequential providing said first arcuate stream, said second arcuate stream and said third arcuate in sequence.

34. A method according to claim 32 including providing at least one manual valve and manually activating said manual valve for controlling the height of at least one of said streams.

35. A method according to claim 34 including providing at least two manual valving means and activating said valves for controlling the height of at least two of said fluid streams.

36. A method according to claim 35 including providing a third manual valve and activating said third manual valve for controlling the height of said third fluid stream.

37. A method according to claim 32 including controlling the sequence of said first, second and third fluid streams electrically.

38. A method according to claim 32 including controlling the operation of said first, second and third fluid streams partly electrically and partly pneumatically.

39. A method according to claim 29 wherein said liquid is selected from soft drinks, beer, wine, gin, vodka, whiskey, scotch, and mixtures thereof.

40. A method according to claim 29 including forming a lighted fluid stream, and directing said lighted fluid stream to said area.

41. A method according to claim 40 including forming said lighted fluid stream with a high energy light source.

42. A method according to claim 41 including forming said lighted fluid stream with a laser.

43. A method according to claim 41 including focusing said light to embed said light within said fluid stream.

44. A method according to claim 40, including causing said lighted fluid stream to enter a glass located on said bar.

45. A method according to claim 29 wherein said valving means is a dump valve and wherein said dump valve is a three-way valve which insures adequate fluid flow velocity to obtain an arcuate fluid stream above slid bar or counter and substantially avoids dripping upon said bar or counter.

46. A method according to claim 45 wherein said dump valve is set to direct fluid flow into a drain from 0.10 to 0.40 sec. before allowing fluid pressure to form said arcuate fluid stream.

47. A method according to claim 29 including providing a deflector adjacent to said opening in said bar and moving said deflector between a first position blocking flow from said bar opening and a second position allowing flow from said bar opening and moving said deflector back and forth to provide discrete fluid streams exiting from said bar opening.

48. A method according to claim 47 including providing a solenoid actuator attached to said deflector and activating said solenoid to move said deflector between said first and said second positions.

49. A method according to claim 47 including providing a pivot point upon said deflector and pivoting said deflector between a position blocking flow from said bar opening and a second position allowing flow from said bar opening and moving said deflector back and forth to allow discrete fluid stream segments to exit from said opening.

50. A method according to claim 29, including causing said fluid stream to flow in a container located upon said bar.

51. A method of moving a liquid in the interior of a building on the horizontal surface of a bar top, which horizontal surface is supported above ground level by at least one vertical leg and is adapted to be surrounded by seating and used as an eating and drinking surface to place food and drinks thereon comprising:

providing a container containing the liquid to be transported to an area on said surface;

providing a source of gaseous pressure to said container;

providing a robe extending into the lower portion of said container and extending upwardly through a valving means in communication with an opening in said surface;

applying gaseous pressure to said container whereby said liquid passes through said robe, through said opening in said surface; and activating said valving means to cause a fluid stream of said liquid to flow from said opening into said area.

52. A method according to claim 51 wherein including forming a laminar fluid stream with said valving means whereby said fluid stream flows arcuately into said container or area.

53. A method according to claim 51 including providing second valving means; supplying fluid pressure to said second valving means, and activating said second valve means to cause fluid to flow from said second valving means arcuately into the area of said first opening in said bar or counter.

54. A method according to claim 53 including providing a third valving means which provides an arcuate fluid stream below said bar or conduit; providing fluid pressure to said third valve means; activating said third valving means sequentially, whereby a first fluid stream flows from said third valving means arcuately to an area adjacent to said second valve means, and a second fluid stream flows from said second valving means to an area adjacent to said first opening and third fluid stream from said conduit flows through said first opening and into said container or area.

55. A method according to claim 54 including providing control means for sequentially providing said first arcuate stream, said second arcuate stream and said third arcuate stream in sequence.

56. A method according to claim 51, including causing said fluid stream to flow into a glass, located upon said bar.

* * * * *